US005864959A

United States Patent [19]

Johansen et al.

[11] Patent Number: 5,864,959

[45] Date of Patent: Feb. 2, 1999

[54] DRAWING TRIANGLE AND/OR PROTRACTOR, IN PARTICULAR FOR BLACKBOARD USE

[75] Inventors: Joern B. Johansen, Hoejbjerg; Nis Oellgaard, Praestehaven 23, DK-8210 Aarhus V, both of Denmark

[73] Assignees: Joern Johansen; Nis Oellgaard, Denmark

[21] Appl. No.: 913,155

[22] PCT Filed: Mar. 5, 1996

[86] PCT No.: PCT/DK96/00092

§ 371 Date: Sep. 8, 1997

§ 102(e) Date: Sep. 8, 1997

[87] PCT Pub. No.: WO96/27503

PCT Pub. Date: Sep. 12, 1996

[30] Foreign Application Priority Data

Mar. 6, 1995 [DK] Denmark ..... 0227/95

[51] Int. Cl.[6] ..... B43L 13/00; B43L 13/20

[52] U.S. Cl. ..... 33/474; 33/1 N; 33/562

[58] Field of Search ..... 33/1 N, 27.02, 33/27.04, 32.1, 424, 474, 463, 481, 483, 492, 534, 562, 565; 434/85, 87

[56] References Cited

U.S. PATENT DOCUMENTS

| | | | |
|---|---|---|---|
| 1,002,734 | 9/1911 | Morse | 33/474 |
| 1,225,464 | 5/1917 | McIntire | 33/474 |
| 1,838,607 | 12/1931 | Zerbel | 33/429 |
| 2,080,620 | 5/1937 | Martin | 33/474 |
| 2,719,359 | 10/1955 | Webber | 33/1 N |
| 3,797,122 | 3/1974 | Smith | 33/562 |
| 3,925,899 | 12/1975 | Hesse et al. | 33/1 N |
| 4,257,164 | 3/1981 | Task et al. | 33/1 N |
| 4,337,577 | 7/1982 | Hotchkiss | 33/1 N |
| 4,926,564 | 5/1990 | Loggins | 33/474 |
| 4,945,642 | 8/1990 | Saulietis | 33/562 |

FOREIGN PATENT DOCUMENTS

| | | | |
|---|---|---|---|
| 191166 | 8/1957 | Austria | 33/474 |
| 2252554 | 5/1974 | Germany . | |

*Primary Examiner*—G. Bradley Bennett

*Attorney, Agent, or Firm*—Antonelli, Terry, Stout & Kraus, LLP

[57] ABSTRACT

A drawing instrument such as a drawing triangle (2) comprising a handle (32) and rulers along edges (10, 12) which mutually form a right angle and two acute angles (6, 8). Alternatively, the drawing instrument may be a protractor (36) having a handle (48) with a circular ruler (38) along its peripheral outer edge. Both the drawing triangle (2) and protractor (36) are provided as a three-dimensional, spatial body having a handle (32, 48) formed by an upper, preferably open, part of the spatial body and having outer side edges (10, 12, 38) which preferably are provided with scales and define a common ground plane adapted to rest against a drawing plane, preferably a generally vertical black-board.

21 Claims, 1 Drawing Sheet

DRAWING TRIANGLE AND/OR PROTRACTOR, IN PARTICULAR FOR BLACKBOARD USE

BACKGROUND OF THE INVENTION

The present invention relates to a drawing triangle or a protractor, in particular for blackboard use.

Known accessories of this type for blackboards consist normally of several parts, namely plane members with different shape—such as triangular, circular or semi-circular plane members provided with handles. Such a construction may cause damage, in form of breaks between the plane member and the handle, or local damage to edges and points caused by pressure.

U.S. Pat. No. 1,225,464 discloses a spatial, closed pyramid-shaped drawing implement, which has four flat side surfaces having their central parts recessed in such a manner that drawing straight edges are formed along the outer side edges of all four flat sides. In other words this known drawing implement has up to four usable sides and is not suitable for use on blackboards.

SUMMARY OF THE INVENTION

The present invention has for its purpose to provide an improved drawing triangle or protractor for use particularly on a blackboard, which may have extraordinary strength, and which has considerable advantages during use in relation to known accessories for blackboards.

The drawing triangle or the protractor according to the invention is distinctive in that outer side edges of said drawing instruments preferably are provided with scales which define a common ground plane and are adapted to rest against a drawing plane, preferably a generally vertical blackboard, such that the spatial body has a form of a pyramid, of which the triangle side surfaces are provided with preferably triangular openings having the same triangular shape as that of said side surfaces. The drawing instrument further is distinctive in that the handle is provided with material between said openings. In a simple manner there is obtained a drawing triangle or a protractor, which may have extra-ordinarily high ultimate strength, and which during use may have considerable advantages. By way of example, the drawing triangle or the protractor may be made with a reduced consumption of material, resulting in a corresponding low net weight. Furthermore, the drawing triangle or the protractor according to the invention, has among other things, because of its spatial construction an improved balance, which makes it easier to handle the drawing implement. Additionally the hollow, spatial configuration of the drawing triangle and the protractor is formed without projecting parts, which is advantageous because the drawing triangle and the protractor thereby are stackable.

The drawing triangle according to the invention may be so configured that the outer side edges form a right angled triangle with acute angles of 30° and 60°. Alternatively the outer side edges may form a right angled triangle with acute angles of 45°. As another alternative, the outer side edges may form an equilateral triangle with angles of 60°.

Appropriately, the protractor according to the invention is so configured that the spatial body has the form of a cone or a spherical segment, in which openings are provided, and that the handle is constituted by material between said openings.

Advantageously the protractor according to the invention may be so configured that it includes an arched ruler stretching about 180° or 360° , and that it is provided with an upright, approximately diametrical transverse rib, which has an under side edge touching the ground plane.

Preferably the handle is constituted by an upright rib stretching from the middle of the transverse rib to the outer side edge.

BRIEF DESCRIPTION OF THE DRAWINGS

The invention is explained in more detail in the following, with reference to the drawing, in which:

FIG. 1 shows a perspective view of an embodiment of a drawing triangle according to the invention, while

DETAILED DESCRIPTION OF PREFERRED EMBODIMENTS

Figure 1:
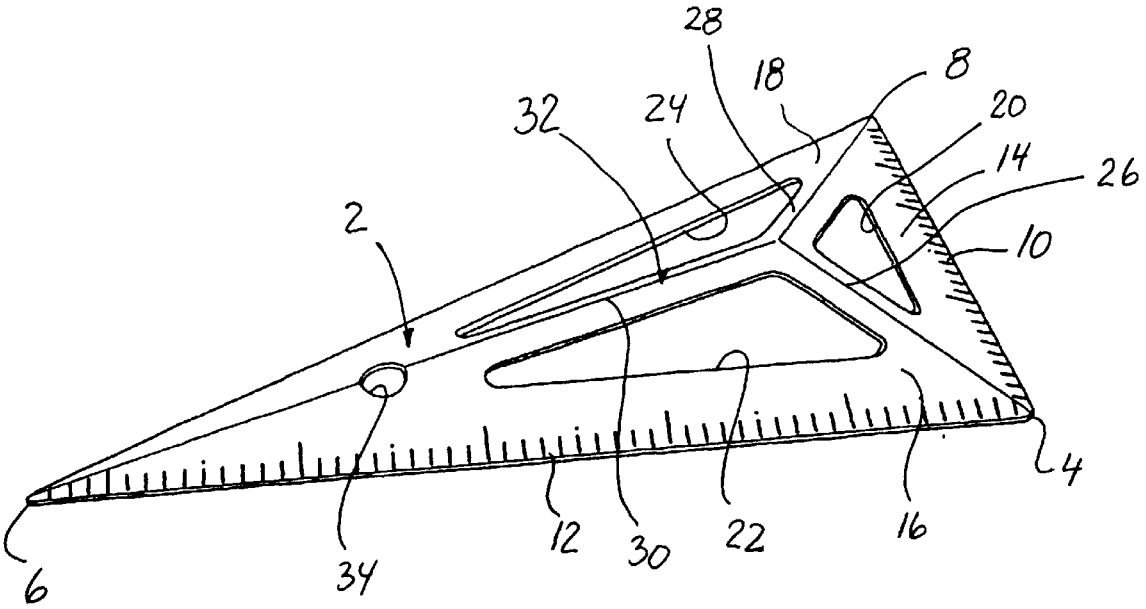

The drawing triangle 2 shown in FIG. 1 has an right angle 4, an angle 6 of 30° and an angle 8 of 60° . The sides 14 and 16 enclosing the right angle of the drawing triangle are provided with scales as rulers along the lower outer edges 10 and 12 of side surfaces 14 and 16, and if desired also 18. The drawing triangle 2 is provided as a spatial pyramid-shaped body, and the triangular side surfaces 14, 16, 18 are provided with generally triangular openings 20, 22, 24.

At the top of the pyramid-shaped body ribs 26, 28, 30 are formed constituting a handle 32 of the drawing triangle. Some distance from the acute 30° angle, a central hole 34 is provided, serving for suspension of the drawing triangle on a wall mounted mounting.

The drawing triangle 2 is preferably manufactured by die casting of a suitable tough, durable plastic material. Alternatively the drawing triangle may be made from a plastic plate by vacuum forming and subsequent copy-milling.

Figure 2:
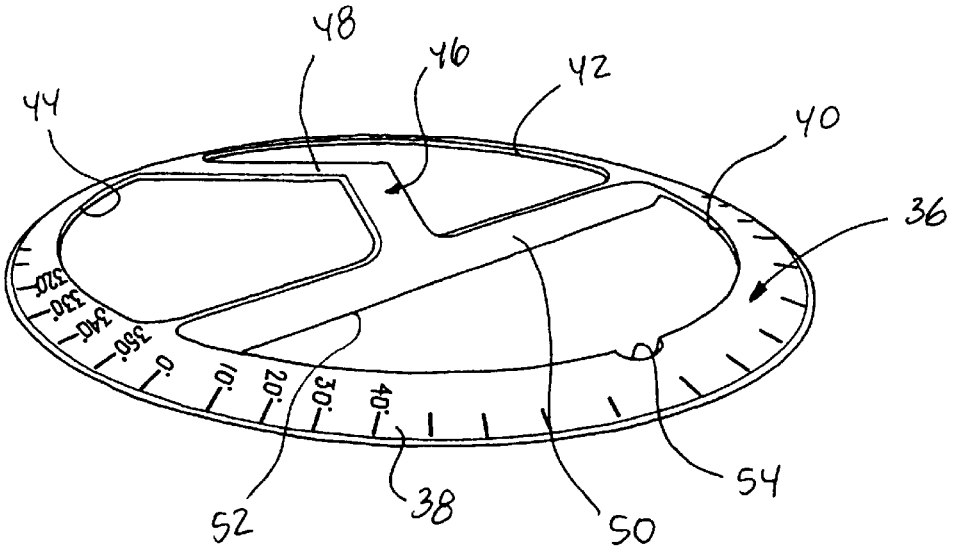
FIG. 2 shows a perspective view of an embodiment of a protractor according to the invention.

The protractor 36 shown of FIG. 2 is also preferably manufactured by die casting in a suitable tough, durable plastic material. The protractor 36 is provided as an open, spatial body with the form of a cone or a spherical segment along its circumference is provided with a calibrated ruler 38. The cone or sperial segment plane is provided three openings 40, 42, 44, so configured that there are formed a central there are rib 46 is formed, which is suitable as a handle 48, and a diametrical rib 50, the lower side edge 52 of which is level with the peripheral outer edge of the protractor 36. Thus, the rib 50 is adapted together with the outer edge of the protracor 36, to rest against a drawing surface, for instance a generally vertical blackboard.

Aligned with the middle or the handle 48 of the rib 46, the opening 40 is provided with a semi-circular recess 54 (or a hole) for suspension of the protractor 36 on a projecting part of a wall mounted suspension mounting.

An alternative protractor may be generally semi-circular in that it does not include the semi-circle portion opposite handle 48. This alternative then might be provided with a central hole for suspension of the protractor.

It will be within the scope of the invention to provide other shapes of the drawing triangle or the protractor for blackboard use, where there are provided an open spatial body with a common outer edge-formed resting surface a central handle positioned at distance from the resting surface. It will also be within the scope of the invention to provide corresponding drawing triangles or protactors in small versions for table use.

We claim:

1. A drawing instrument comprising a base member and a handle member, said base member and said handle member being made from thin plate material and cooperating to form a three-dimensional, spatial body, said base member having outer edges lying in a plane and adapted to rest against a planar drawing surface, said spatial body having a plurality of openings therein to permit ready grasping of said drawing instrument by said handle.

2. A drawing instrument according to claim 1, wherein said base member comprises a triangular member.

3. A drawing instrument according to claim 2, wherein said handle member is formed by material between the openings in said spatial body.

4. A drawing instrument according to claim 2, wherein said triangular member defines a right angled triangle with acute angles of 30° and 60°.

5. A drawing instrument according to claim 2, wherein said triangular member defines a right angled triangle with acute angles of 45°.

6. A drawing instrument according to claim 2, wherein said triangular member defines an equilateral triangle.

7. A drawing instrument according to claim 1, wherein said base member comprises a protractor member.

8. A drawing instrument according to claim 7, wherein said spatial body comprises a spherical segment.

9. A drawing instrument according to claim 7, wherein said base member comprises a circular member, and said spatial body includes an upright, substantially diametrically transverse rib having an under side edge lying in said plane.

10. A drawing instrument according to claim 9, wherein said handle comprises an upright rib extending from the middle of said transverse rib to the outer edge.

11. A drawing instrument according to claim 7, wherein said base member comprises a semi-circular member and a diametrical rib extending across the ends of said semi-circular member.

12. A drawing instrument according to claim 7, wherein said handle member is formed by material between the openings in said spatial body.

13. A drawing instrument according to claim 1, wherein said handle member is formed by material between the openings in said spatial body.

14. A drawing instrument according to claim 1, wherein said spatial body has a suspension opening therein, permitting suspending of said drawing instrument from a mounting member.

15. A drawing instrument according to claim 1, wherein said base member has calibration markings therealong.

16. A drawing triangle comprising three thin, plate-like triangular members; each triangular member having a first side edge connected to a side edge of another one of said triangular members and a second side edge connected to a side edge of a further one of said triangular members so that said three triangular members form a three-dimensional, spatial body with the third side edges of each of said three triangular members lying in a common plane and adapted to rest against a planar drawing surface; each triangular member having a triangular opening therethrough permitting said connected side edges provide a handle for said drawing triangle.

17. A drawing instrument according to claim 16, wherein said triangular member defines a right angled triangle with acute angles of 30° and 60°.

18. A drawing instrument according to claim 16, wherein said triangular member defines a right angled triangle with acute angles of 45°.

19. A drawing instrument according to claim 16, wherein said triangular member defines an equilateral triangle.

20. A drawing instrument according to claim 16, wherein said handle member is formed by material between the openings in said spatial body.

21. A drawing protractor comprising a base member formed of thin, plate-like material in the shape of a spherical segment; and a substantially diametrical rib member extending across said base member; and a second rib member extending from said base member to said substantially diametrical rib member; said base member and said rib members cooperating to form a three-dimensional, spatial body with said base member having an outer edge lying in a plane and adapted to rest against a planar drawing surface and having openings therethrough permitting said second rib member to provide a handle for said drawing protractor.

* * * * *